United States Patent [19]

König

[11] 4,446,975

[45] May 8, 1984

[54] ROTARY CRANE

[76] Inventor: Wilhelm König, Bungertweg 10, 5020 Frechen b. Köln, Fed. Rep. of Germany

[21] Appl. No.: 471,145

[22] Filed: Mar. 1, 1983

[30] Foreign Application Priority Data

Mar. 2, 1982 [DE] Fed. Rep. of Germany ..... 3207443

[51] Int. Cl.[3] ..... B66C 23/42; B66C 23/02

[52] U.S. Cl. ..... 212/188; 212/199; 212/239; 212/232

[58] Field of Search ..... 212/182–187, 212/199, 203, 223, 227, 231–232, 237, 239, 255, 260, 262, 266

[56] References Cited

U.S. PATENT DOCUMENTS

| | | | |
|---|---|---|---|
| 3,161,299 | 12/1964 | Noly | 212/184 |
| 3,233,375 | 2/1966 | Durand | 212/184 |
| 3,378,147 | 4/1968 | Marrie | 212/184 |
| 4,267,934 | 5/1981 | Vernay | 212/184 |

FOREIGN PATENT DOCUMENTS

| | | | |
|---|---|---|---|
| 1285703 | 12/1968 | Fed. Rep. of Germany | 212/231 |
| 1289970 | 2/1969 | Fed. Rep. of Germany | 212/184 |
| 2223665 | 11/1973 | Fed. Rep. of Germany . | |
| 2252279 | 6/1975 | France | 212/184 |
| 2306158 | 10/1976 | France | 212/184 |

*Primary Examiner*—Trygve M. Blix
*Assistant Examiner*—R. B. Johnson
*Attorney, Agent, or Firm*—Michael J. Striker

[57] ABSTRACT

A rotary crane having a telescopic mast with a liftable upper portion and a boom pivotally mounted at the end of that portion. The boom includes an end hinged element, a hinged tip and an intermediate member between the end element and the tip. Each portion of the boom is of a triangular shape and has two lower chords and one upper chord interconnected by rods. The boom is foldable and expandable by a rope system which includes boom supporting ropes and a boom folding rope. The end hinged element is connected to the intermediate member by a shackle having an oblong opening into which a pin is inserted to pivotally connect the end element to the intermediate member.

17 Claims, 13 Drawing Figures

ROTARY CRANE

BACKGROUND OF THE INVENTION

The present invention relates to rotary cranes in general, and more particularly, to the rotary crane having a telescopic mast carrying a foldable boom at the upper end thereof.

Rotary cranes of the type under discussion include a boom formed of a number of hinged elements each formed of a frame of a triangular shape, which elements are hingedly connected to each other to form the boom which may be folded up or expanded. Each hinged element may be formed of two lower chords and one upper chord. The chords are connected to each other by rods. The crane is normally provided with a rope system.

Rotary cranes of the type under consideration and having three hinged elements have a relatively large working zone, for example about 45 meters.

The disadvantage of these otherwise satisfactory rotary cranes is that they have large width when transported on highways if the boom tip is not disassembled from the remaining hinged portions of the boom.

It should be also noted that with the known constructions the raising of the crane with a twofold support of the boom and where the end hinge element and the intermediate element each has an individual boom supporting rope is complicated. The raising of the crane has been up till now performed in such a fashion that the mast was first lifted and than its upper telescopic portion was moved in the upward direction. Then the boom tip was released from the anchorage and lifted from the hinge on the mast and released from the ground by hand of an operator. The upper portion of the mast was again moved further in the upward direction and the intermediate hinged element was pivoted, connected to the end hinged element and both elements were aligned by hand in the vertical direction. The upper portion of the mast then was lowered unless the intermediate element has been positioned near the ground. After that, also by hand with the aid of two operator forces, the boom tip was attached to the intermediate element of the boom by bolts. The inner mast portion was then fully raised upwardly and the boom was lifted to a horizontal position by means of the boom supporting rope, a motor and a rope drum driven by a tackle. The above described operation requires manual labor and is extremely time consuming. In the known mode of operation of the crane the inner mast must be raised and descended for several times. Thus the known structures have been considered as troublesome and complex.

The crane described in German Pat. No. 20 20 238 has a boom comprised of two elements. This crane has a folding rope fixed to the lower boom element and directed to a deflection roll mounted on the telescopic mast. The boom can be pivoted, folded and expanded without shortening or lengthening of the folding rope during the raising of the upper portion of the telescopic mast.

SUMMARY OF THE INVENTION

It is an object of the invention to provide an improved rotary crane.

It is a further object of the invention to provide a rotary crane with the telescopic mast and at least two hinged frame elements foldable by a rope system, which can be adjusted to its operation position or to its traveling position by very simple means and by only one operating force and in comparably shorter time and without changing the length of the boom supporting rope and boom folding rope so that no special rope coils with necessary motors are required and which crane requires only one motor with the rope roll for telescopic movement of the mast.

These and other objects of the invention are attained by a rotary crane, comprising a carriage; a telescopic mast on said carriage having an inner portion movable upwardly from a remaining portion of the mast and having an upper end; a pivotable boom mounted at said end; said boom including at least one hinged element connected to said end, a boom tip and at least one intermediate hinge member interconnected between said hinged element and said tip; a hinged support mounted at the end of said inner portion; a rope system connected to said intermediate hinged member and said hinged element, deflected at said hinged support and connected to said carriage for supporting and folding said boom such that it is folded to be in a transport position or expanded to be in an operation position, said hinged element, said intermediate member and said tip being each of a triangular shape and including two lower chords spaced from each other and one upper chord, said chords being respectively connected to each other by rods; shackle means connecting the upper chord of the hinged element with the upper chord of the intermediate member such that they can pivot in a vertical plane with respect to each other, said shackle means being formed with an oblong opening extending in the direction of elongation of the boom when the latter is in its expanded position and including a pin insertable into said opening; and means for laterally interlocking the respective lower chord of the intermediate member with the respective lower chord of the hinged element.

The rotary crane according to the invention having a three-piece boom, in which the end hinged element and the intermediate member are connected to each other by the boom supporting rope and by means of the shackle, provides the possibility that the upper chords of the hinged portions of the boom can change their distance from each other within predetermined limits and thus the boom portions or elements have certain freedom of movement such that the boom supporting rope corresponding to the respective boom portion is fully utilized.

In the crane boom of the invention the upper chords of the respective hinged elements are connected to each other firmly but with a sufficient play. This results not only in very effective operation of the boom supporting rope but is also advantageous in assembling of the crane. The upper chords of the hinged elements of the boom are reliably connected to each other by a pin inserted into the oblong opening of the shackle whereby with the unchanged length of both the end hinge element and the intermediate member, the boom supporting rope of the unchanged length can be used. Thus the boom can be folded and expanded and pivoted in its expandable position when said inner portion is moved upwardly without shortening or lengthening of said boom folding rope.

In accordance with a further feature of the invention the crane may include a first roll at said upper end, a second roll at said upper end spaced from said first roll and a third roll at a lower end of the inner portion of the mast, the boom folding rope being directed from the end hinged element about said first roll, then said third roll and said second roll towards the crane carriage.

Furthermore, the crane may include a rope support provided on the intermediate member for supporting said boom supporting rope and said boom folding rope when the boom is in its expanded position.

According to still another feature of the invention the rope support may be mounted on two lower chords of the intermediate member in the region of said shackle means, said rope support being pivotally positioned with respect to the end hinged element and the intermediate member.

The shackle means may include a connecting shackle, a first shackle rigidly connected to the upper chord of the hinge element and a second shackle rigidly connected to the upper chord of the intermediate member, said connecting shackle being pivotally connected to the first shackle and the second shackle, respectively.

The connecting shackle and said first shackle each may be formed with a similar hole. The crane may include an additional pin insertable in the holes of the connecting shackle and the first shackle, said first shackle being pivotable about said additional pin.

The connecting shackle and the second shackle may be each formed with the aforementioned oblong opening for receiving said aforementioned pin, said second shackle being pivotable about said aforementioned pin.

The connecting shackle may include a plurality of plates spaced from each other and forming a bridge between the first shackle and the second shackle.

The first shackle may be welded to the upper chord of the hinged element and the second shackle may be welded to the upper chord of the intermediate member.

According to a still further feature of the invention the first shackle may be formed with a projection with a first bearing surface, said connecting shackle having a bearing plate at a lower edge thereof, said bearing surface abutting against said bearing plate when said first shackle is pivoted towards said connecting shackle, said second shackle being formed with a hooked lug having a bearing surface and said connecting shackle having a second bearing plate at an upper edge thereof, said bearing surface of the hooked lug abutting against the bearing plate at said upper edge when said second shackle is pivoted with respect to said connecting shackle, the first bearing surface and said second bearing surface abutting against the respective bearing plates alternately.

The first and second shackles may be each provided with lateral auxiliary shackles.

Furthermore, the plates of the connecting shackle may be connected to each other and to the auxiliary shackles of the first and second shackles, respectively by tubular members welded to the respective plates, said first mentioned pin and said additional pin extending through respective tubular members.

The crane may further include plates pivotally connecting the end hinged element and the intermediate member to each other.

The connecting plates may extend transversely to the respective upper chords of the hinged element and the intermediate member and connected to each other by means of a pivot axle extended in the direction parallel to said upper chords and laterally spaced from said upper chords.

Furthermore the lower chords of the boom tip may be pivotally connected to the respective lower chords of the intermediate member by means of pivotable shackles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
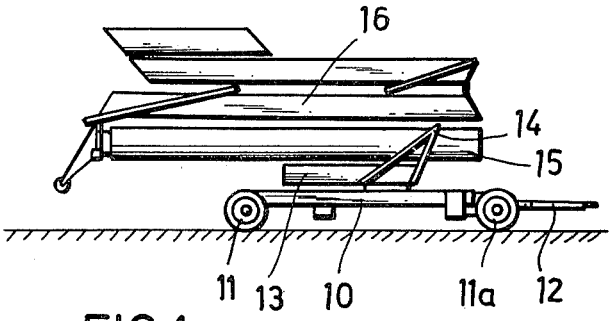
FIG. 1 is a schematic side view of the crane in a folded-up position in which the crane is to be moved.

Referring now to the drawing, FIG. 1 illustrates the rotary crane of the invention in its ready-to-move position. The crane comprises a lower carriage 10 provided with wheels 11, 11*a* and a wagon shaft 12 by which the crane is connected to a vehicle. A rotatable upper carriage 13 is mounted on the lower carriage 10. A pivotable telescopic mast 15 is connected to the carriage 13 by means of a hinged support 14. Mast 15 is comprised of an outer mast and an inner or upper mast 15*a* telescopically movable into and from the outer mast. At the upper end of the inner mast 15*a* is supported a boom generally designated as 16 and comprised of a number of frame portions or hinged elements.

Figure 2:
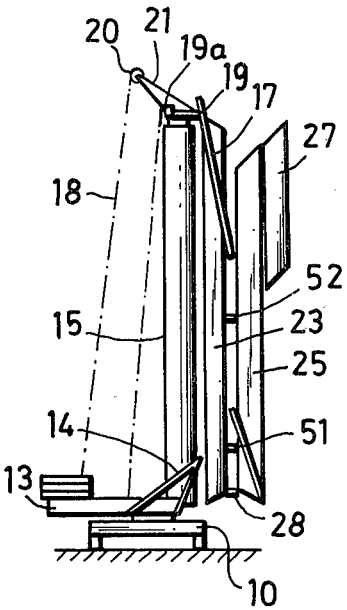
FIG. 2 is a schematic view of the crane with an upright mast and a folded-up boom.

As shown in FIG. 2 the lower carriage 10 and the rotatable upper carriage 13 thereon support the mast 15 which is pivoted from the horizontal position as in FIG. 1 to the vertical position in the known fashion. Mast 15 as was mentioned above has an inner mast 15*a* at the upper end of which is provided in the known manner a hinged support 17. This hinged support is pivoted first about an axle 19, then about a pivot axle 19*a*. This known fashion is described, for example in German Pat. No. 2,223,665.

Figure 3:
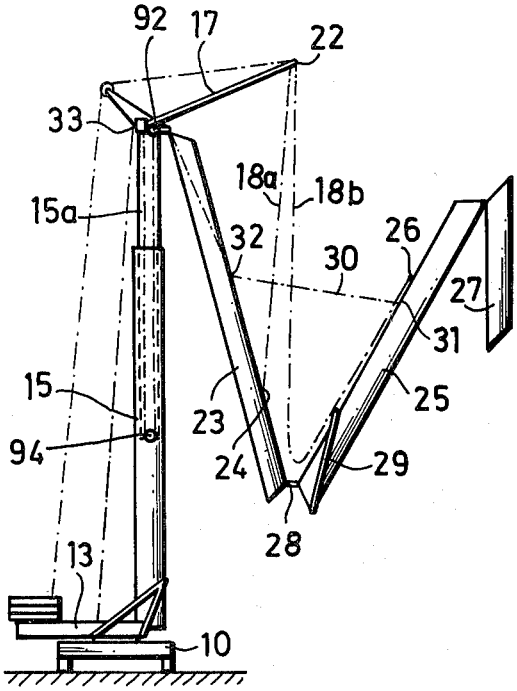
FIG. 3 is a schematic view of the crane of FIG. 2 but with a partially raised inner mast and a partially expanded boom.

A boom supporting rope 18 is fed from the upper carriage 13 to and about a roll 20 which is supported on an arm 21, which in turn is connected to the inner mast 15*a*. Rope 18 is then fed to a tip or head 22 of the hinged support 17 (FIG. 3). Another boom supporting rope 18*a* is arranged on tip 22 of the hinged support 17, rope 18*a* being connected with a first hinged element 23 of the boom at the upper chord thereof and at the point denoted as 24. A further boom supporting rope 18*b* is also connected to the tip 22 of hinged support 17, rope 18*b* being connected with the upper chord of an intermediate hinged element 25 of the boom at the point 26. The front end of the intermediate hinged element 25 is connected in the manner to be described herein below to a further hinged element or tip 27 of the boom. All hinged elements 23, 25 and 27 are triangular in their cross-section and have upper chords and lower chords connected to each other respectively as will be explained below.

As shown in FIG. 3, two jointed ends of the hinged elements 23 and 25 are connected to each other at their upper chords by means of a shackle 28. An additional hinged support 29 is arranged at the lower chord of the intermediate hinged element 25 in the region of the lower chord of hinged element 23, which hinge support has at its upper end a fork or a roll 34 (shown in FIG. 4) for receiving the boom supporting rope 18*b* and a boom folding rope 30. The boom folding rope 30 is directed over defection roll 31 at the upper chord of intermediate hinged element 25 and over a deflection roll 32 at the upper chord of the hinged element 23 from which roll rope 30 is deflected and fed to the upper end of inner mast 15*a*. Two deflection rolls 92, 33 are mounted at the upper end of mast 15*a* in a spaced relationship to each other. Rope 30 is fed over the first roll 92, then is directed over a deflection roll 94 provided at the lower end of the inner mast 15*a* and then is fed over the second roll 33 at the upper end of mast 15*a* toward the carriage 13 so that if the boom folding rope 30 is of constant length the full pivoting out and expanding of the boom hinged elements 23 and 25 is ensured when the inner mast 15 is in its most expanded outward position as shown in FIG. 4.

Figure 4:
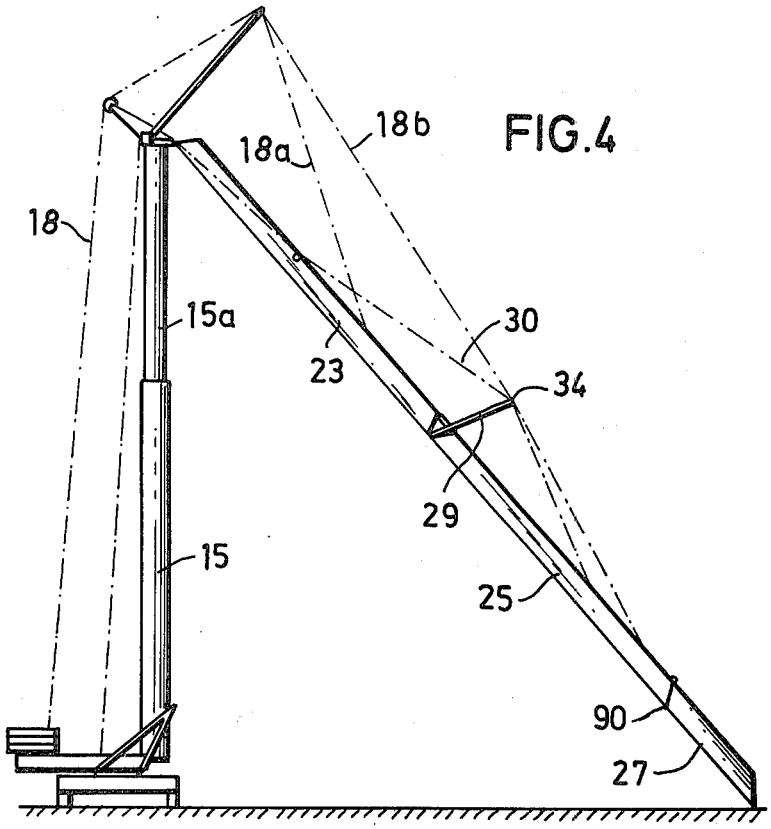
FIG. 4 is a schematic view of the crane with the fully expanded boom.

FIG. 4 also illustrates that in the expanded position of the boom 16 the boom folding rope 30 is deflected over the roll 34 mounted on the rope support 29. The boom supporting rope 18*b* is also supported on the rope support 29, as seen from FIG. 4, when the boom is in its expanded position. In the position shown in FIG. 4 the tip 27 of the boom is shown in the position in which it is pivoted at the point denoted as 90 relative to the lower chord of the intermediate hinged element 25 about the horizontal axis so that the tip 27 is aligned with the elements 23 and 25, the upper chord of the hinged element 23 is locked with the upper chord of the intermediate element 25 in any conventional suitable fashion and the boom is fully expanded. The above locking connection between the elements 23 and 25 in their expanded position can be performed by a remote operation in connection with a tackle used for further arranging of the mast.

Figure 5:
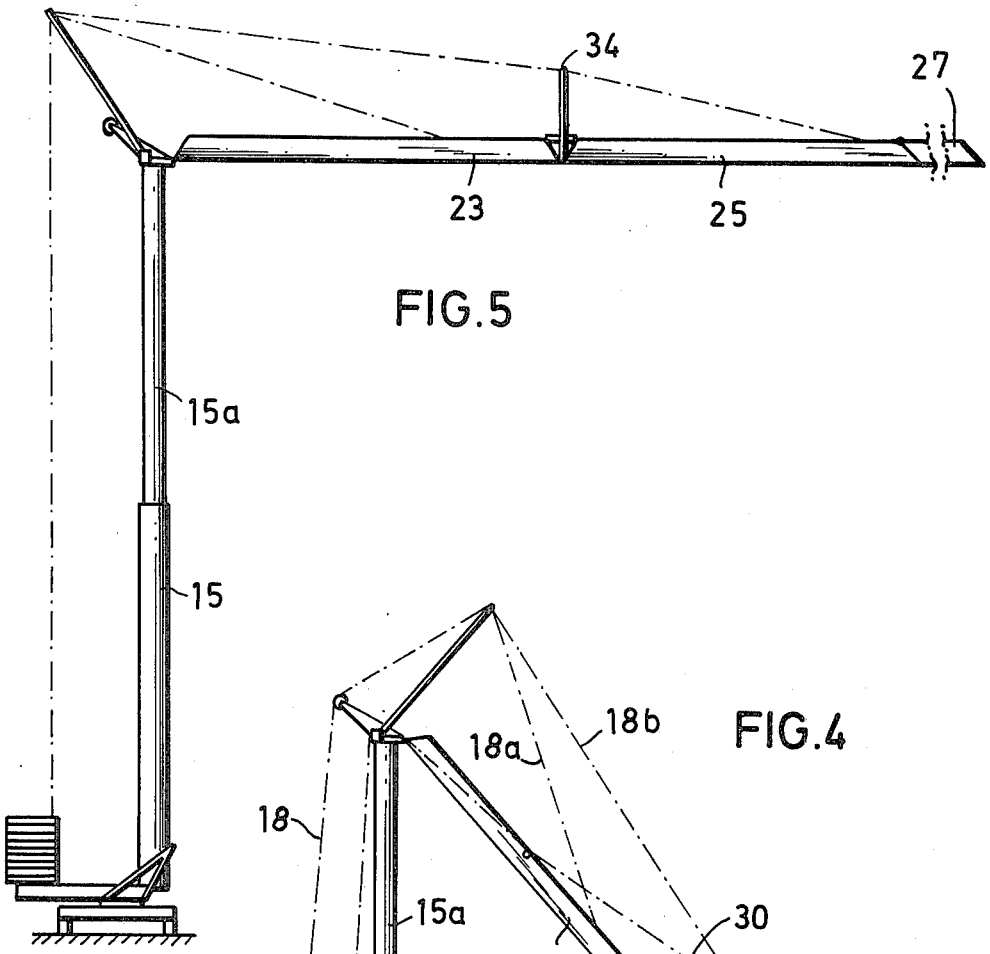
FIG. 5 is a schematic view of the crane in its operation position.

If hinged elements 23, 25 and 27 of the boom 16 are expanded and boom supporting ropes 18, 18*a* and 18*b* are under tension the boom can be swung out from its slanted position shown in FIG. 4 to its horizontal position depicted in FIG. 5 by further raising the inner mast 15*a* upwardly from the lower part of the telescopic mast 15.

Figure 7:
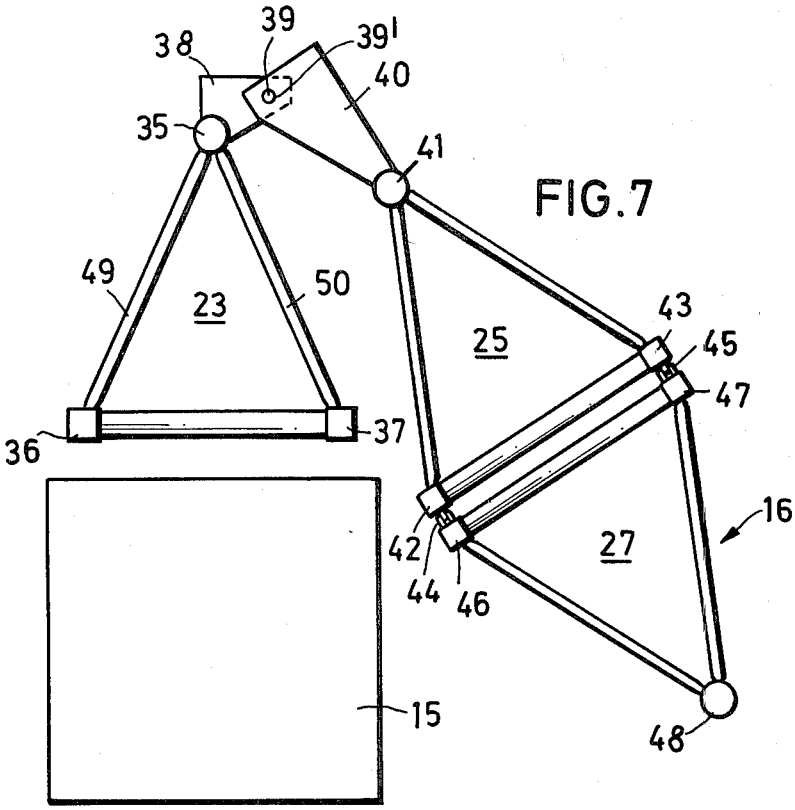
FIG. 7 is a schematic view, on the enlarged scale, of the three hinged elements of the boom connected to each other and shown in the position cooresponding to that of FIG. 1.
Figure 8:
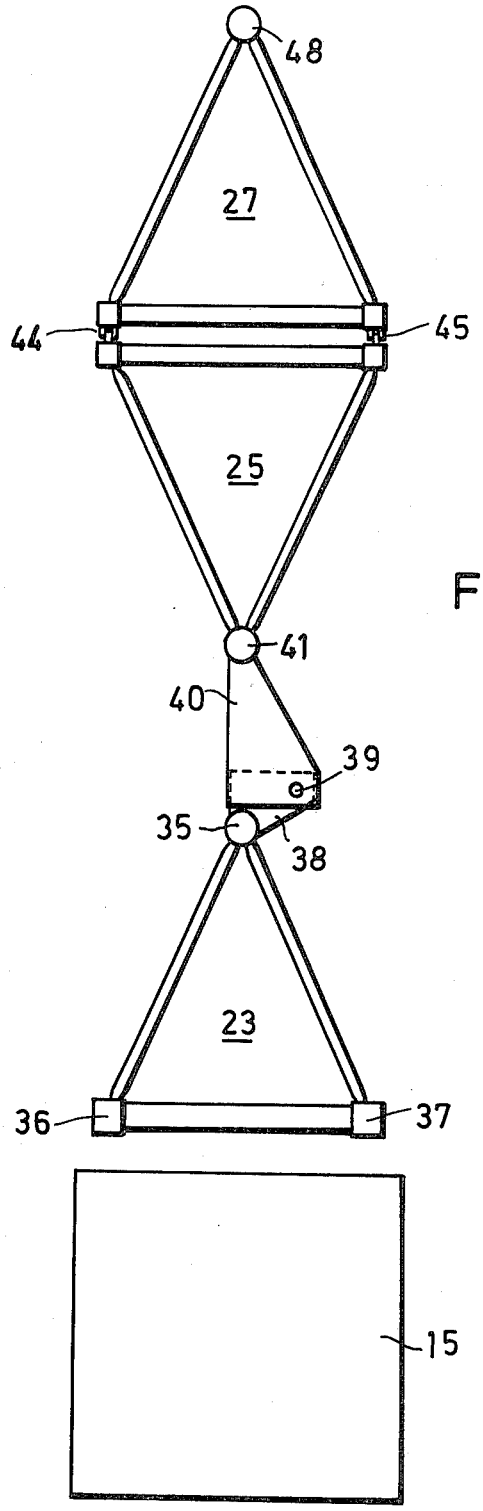
FIG. 8 is a schematic view, on the enlarged scale, of the three hinged elements of the boom connected to each other and shown in the position corresponding to that of FIG. 2.

Reference is now made to FIGS. 7 and 8 illustrating the three-piece boom 16 in two different positions. The position of boom 16 in FIG. 7 corresponds to that of FIG. 1 where mast 15*a* is in its lowermost position and hinged element 23 including an upper chord 35 and lower chords 36, 37 is positioned thereon. All upper chords of the frame elements of the boom are tubes of circular cross-section. The upper chord 35 is connected to a plate 38 of approximately triangular shape and extended radially of the chord 35 to which it is welded. Another plate 40 also of substantially triangular shape is welded to the upper chord 41 of the intermediate hinged element 25 and also radially extended with respect to chord 41. Plate 38 is formed with a bore 39' radially offset, preferably about 16 cm, from chord 35. It is understood that plate 40 is also formed with a similar bore so that when plates 38 and 40 are connected to each other a pin 39 extends through bores 39' of both plates.

Lower chords 42 and 43 of the intermediate hinged element 25 are provided in the region of their connection to the boom tip 27 with shackles 44 and 45 which, via the corresponding shackles on the lower chords 46 and 47 of the boom tip 27 and respective pins, are pivotally movable such that the boom elements 25 and 27 can be pivoted relative to each other. Tip 27 also has the upper chord 48. The lower chords of the intermediate hinged element 25 and hinged element 23 are connected with the respective upper chords by means of known per se diagonal rods 49, 50.

As soon as the crane is required to be adjusted from its ready-to-move position for traveling on the road shown in FIG. 7 to its operation position, mast 15 is raised by means of the hinged support 14 and a suitable tackle normally used for this purpose. It should be, however provided that the three pieces of the boom, namely the hinged elements 23, 25 and 27, should be in the proper orientation with respect to each other (as shown in FIG. 8 of the drawing) when the mast 15*a* is lifted whereas in the transport position of the crane the hinged elements 23 and 25 and tip 27 should be laterally offset one relative to another and the tip should be positioned below the intermediate frame element. The necessary orientation of the hinged elements of the boom relative to each other is obtained by loosening of the supports, which is determined for special traffic conditions, and by pivoting the intermediate hinged element 25 together with tip 27, to which it is connected by shackles 44, 45, about the pivot or pin 39 extending through bores 39' to the position shown in FIG. 8 while the mast 15*a* is in its lifted position. In such an oriented position hinged element 23 and intermediate hinged element 25 are arranged in mirrow-image position with respect to each other. This position corresponds to the position of the crane shown in FIG. 2. Thus the hinged element 23 and intermediate hinged element 25 are first held spaced apart from each other at the positions 51 and 52 shown in FIG. 2 by two plates 38 and 40.

Figure 6:
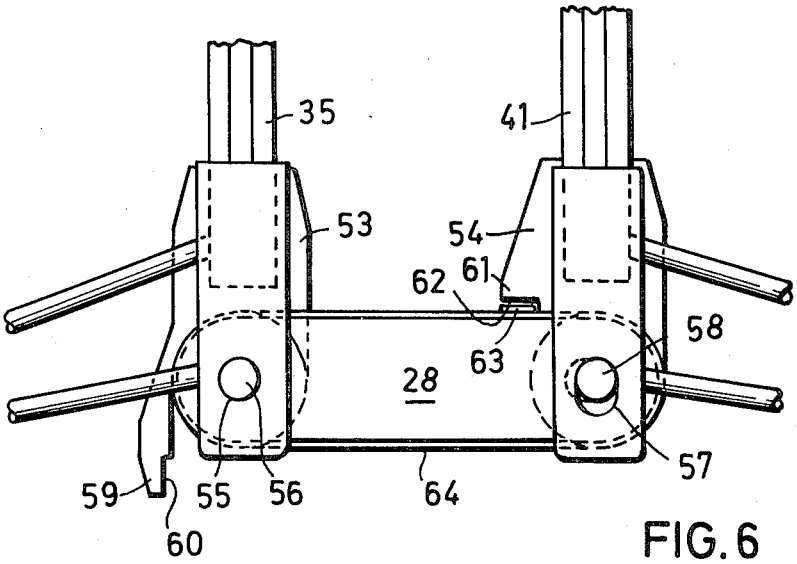
FIG. 6 is a schematic view of a shackle connecting two hinged elements of the boom, on the enlarged scale.

Referring now to FIG. 6 this figure shows a connection between the upper chord 35 of the element 23 to the upper chord 41 of the element 25 in the lower region thereof. The position of the chords 35 and 41 illustrated in FIG. 6 corresponds to the position of the crane in FIG. 2. As shown in FIG. 6 a first shackle 53 is welded to the upper chord 35 and a second shackle 54 is welded to the upper chord 41 of the intermediate frame element. Shackle 53 has a circular bore 55 for receiving a pin 56. Shackle 54 in turn is formed with an oblong opening 57 receiving a pin 58. The connection between chords 35 and 41 is also illustrated in FIGS. 9–13.

If the diameter of pin 58 is, for example, about 60 mm the oblong opening has the length of 80 mm so that the play of about 2 cm is provided. This play thus ensures a movement compensation of about 2 cm. Depending upon the length of the frame element 23 the movement compensation play may be selected from 1 to 3 cm, preferably from 1.5 to 2.5 cm. In any case this size must ensure that the length of the oblong opening should be greater than the diameter of the pin. The oblong opening 57 extends in the direction of elongation of the respective structural component in which the opening is formed. Thus the corresponding oblong opening in the shackle 28 extends in the horizontal direction in the plane of FIG. 6.

Shackle 53 is provided with a projection 59 having a bearing surface 60 which extends in the direction of elongation of the upper chord 35 whereas shackle 54 on the upper chord 41 has a hooked lug or projection 61 provided with a bearing surface 62 which extends transversely or radially of the direction of elongation of the upper chord 41. As seen from FIG. 9 in the expanded position projection 59 of shackle 53 is turned in the inward direction whereas projection 61 of shackle 54 is turned in the outward direction with respect to shackle 28. Both shackles 53 and 54 are pivoted on shackle 28 and the circular bore 55 receiving pin 56 and oblong opening 57 receiving pin 58 are formed in shackle 28 and shackles 53 and 54, respectively. The shackle 28 is provided with a transversal plate 63 at the upper side thereof and a transversal plate 64 at the lower side thereof. In the position shown in FIG. 6 corresponding to the position of the crane in FIG. 2 and to the position of plates 38 and 40 shown in FIG. 8 it is ensured that hinged element 23 and intermediate hinged element 25 are firmly held and can not be displaced one relative to another. Shackle 28 is then pivoted, preferably continually pivoted, on shackle 53 about pine 56. In this position shackle 28 hangs downward. Then pin 58 is removed from the oblong opening 57 of shackle 28 or shackle 54 and shackle 28 is then pivoted to a horizontal position in which the oblong openings of shackle 28 and shackle 54 are in alignment. Pin 58 is then again inserted into the oblong openings of shackles 28 and 54 to connect the latter to each other in the horizontal position. Oblong openings in shackles 28 and 54 are preferably made during the assembly of the crane. For this purpose the shackles 28 are 54 are so oriented that bearing surface 62 of hooked lug or projection 61 of shackle 54 abuts against or somewhat spaced from the transversal plate 63 as shown in FIG. 6. As, upon the movement of the inner mast 15*a* upwardly and outwardly from the outer portion of mast 15, the hinged element 23, and the intermediate element 25 are forced apart from each other and plates 40 and 38 are also moved away from each other (this results in that the bearing surface 62 of shackle 54 is against the transversal plate 63), the intermediate element 25 is not displaced downwardly relative to the hinged element 23. When the hinged element 23 and intermediate hinged element 25 reach their expanded position as shown on FIG. 4 the bearing surface 60 of projection 59 of shackle 53 abuts against the transversal plate 64 of connecting shackle 28 as seen from FIG. 9.

Figure 9:
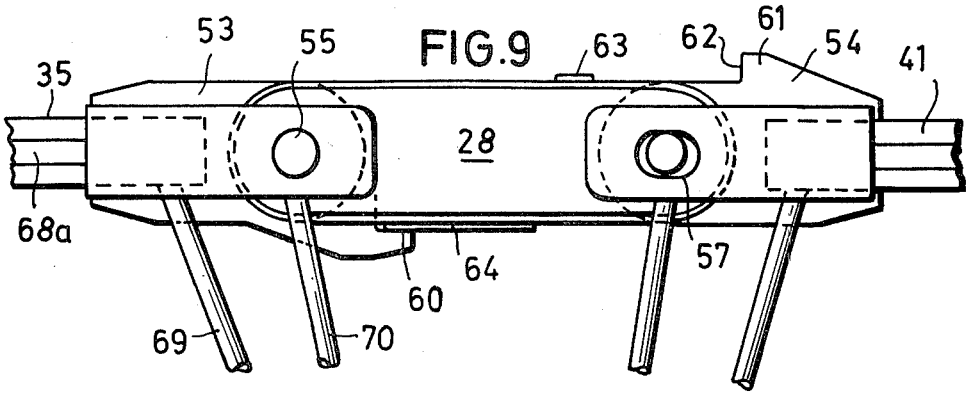
FIG. 9 is a side view of the shackle shown in FIG. 6.
Figure 11:
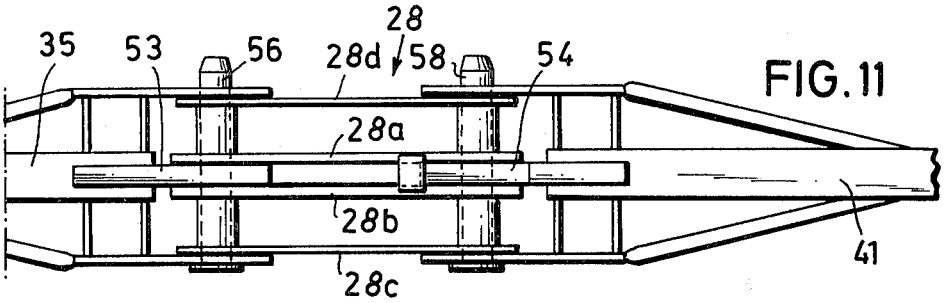
FIG. 11 is a top plan view of the shackle of FIG. 9.
Figure 12:
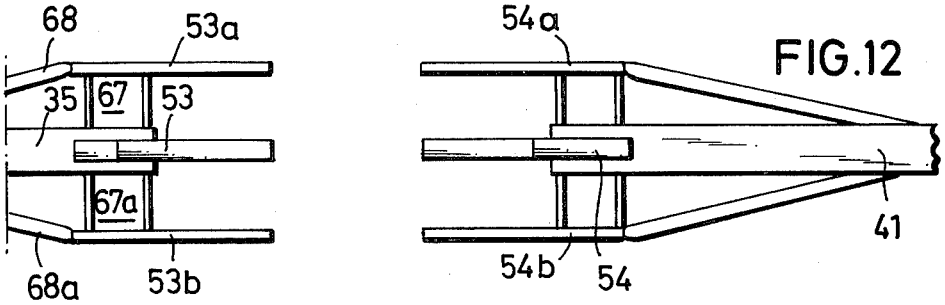
FIG. 12 is a view similar to that of FIG. 11 but showing two connected ends of the end hinged element and the intermediate hinged element of the boom.
Figure 13:
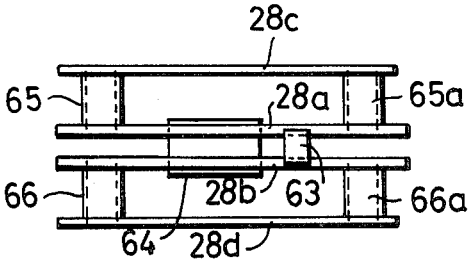
FIG. 13 is a top plan view of the part of the schackle of FIG. 11.

FIGS. 11 through 13 show various views of shackle connection illustrated in FIG. 9. As shown in FIG. 11 shackle 28 is formed as a bridge comprised of four plates 28*a*, 28*b*, 28*c* and 28*d*. Plates 28*a* and 28*b* are connected to each other at their respective edges by the transversal plate 63 and at their opposite respective edges by the aforementioned transversal plate 64 as shown in FIG. 13. Plates 28*a* and 28*c* are connected to each by tubes 65, 65*a* and plates 28*b* and 28*d* are connected to each other by tubes 66, 66*a*. All tubes 65 through 66*a* receive pins 56 and 58, respectively as shown in FIG. 11.

As depicted in FIG. 12 shackle 53 is provided with auxiliary shackles 53*a* and 53*b* which are connected to chord 35 by rods 68 and 68*a* whereas shackle 54, which is in mirrow image position with shackle 53, is formed with auxiliary shackles 54*a*, 54*b* connected to chord 41. Shackle 53 and auxiliary shackles 53*a*, 53*b* are connected to chords 35 and 41, respectively, by connecting rods 67, 67*a*. It is to be understood that shackles 54*a*, 54*b* should be formed with oblong openings. The oblong opening 57 ensures the traveling path of chords 35 and 41 within certain limits depending upon the tension of boom supporting ropes 18*a* and 18*b*.

The structure of the shackles according to the invention makes it possible than the rotary crane can be always adjusted to a favorable position when it is rotated to its operation state.

Figure 10:
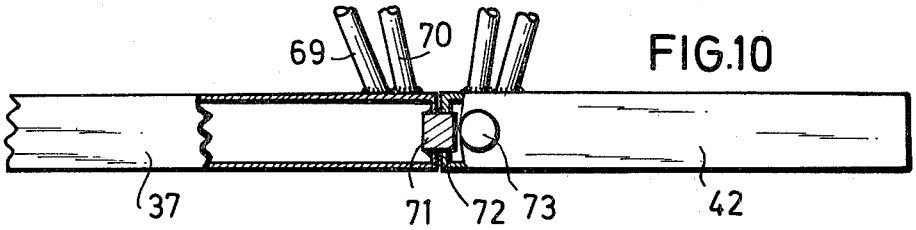
FIG. 10 is a partial sectional view illustrating a connection between a lower chord of one hinged element with an upper chord of the intermediate hinged element.

With reference to FIGS. 9 and 10 it is seen that the upper chord 35 of the hinged element 23 is connected to the lower chord 37 by means of rods 69. In addition, a rod 70 is provided to connect the auxiliary shackle 53*b* with the lower chord 37. It is, of course, to be realized that the connection from the respective shackle to the chord 36 and the chords of the intermediate hinged element 25 is similar to that described for chord 37.

With reference to FIG. 10 it is seen that a pin or stud 71 is provided at the lower chord 37 of the hinged element 23 which can be interlocked in a respective bore 72 provided in the lower chord 42 of the intermediate hinged element 25. The latter is further provided with a transversal pin 73 welded thereto which is constructed for providing the pivoting position of the rope support 29 supporting boom supporting rope 18 and boom folding rope 30.

It will be understood that each of the elements described above, or two or more together, may also find a useful application in other types of rotary cranes differing from the types described above.

While the invention has been illustrated and described as embodied in a rotary crane, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Rotary crane comprising a carriage; a telescopic mast on said carriage having an inner portion movable upwardly from a remaining portion of the mast and having an upper end; a pivotable boom mounted at said end; said boom including at least one end hinged element connected to said end, a boom tip and at least one hinged intermediate member interconnected between said hinged element and said tip; a hinged support mounted at the end of said inner portion; a rope system connected to said intermediate hinged member and said hinged element and deflected at said hinged support and connected to said carriage for supporting and folding said boom such that the boom is folded to be in a transport position or expanded to be in an operation position, said end hinged element, said intermediate member and said tip each being of triangular shape and including two lower chords spaced from each other and one upper chord, the chords in said end hinged element, in said member and in said tip being connected to each other respectively by rods; shackle means connecting the upper chord of the hinged element with the upper chord of the intermediate member such that they can pivot in a vertical plane with respect to each other, said shackle means being formed with an oblong opening extending in the direction of elongation of the boom when the latter is in its expanded position and including a pin insertable into said opening; and means for laterally interlocking the respective lower chord of the intermediate member with the respective lower chord of the end hinged element.

2. The crane as defined in claim 1, wherein said rope system includes a boom supporting rope and a boom folding rope of constant length, and further including a deflection roll mounted on said hinged element, said boom folding rope being fed from said intermediate member to said deflection roll and deflected therefrom to said inner portion of the mast and then to said carriage, said boom being foldable and expandable and pivotable in its expandable position when said inner portion is moved upwardly without shortening or lengthening of said boom folding rope.

3. The crane as defined in claim 2, further including a first roll at said upper end, a second roll at said upper end spaced from said first roll and a third roll at a lower end of said inner portion, said boom folding rope being directed from said end hinged element about said first roll, then said third roll and said second roll towards said carriage.

4. The crane as defined in claim 3, further including a rope support provided on said intermediate member for supporting said boom supporting rope and said boom folding rope when the boom is in its expanded position.

5. The crane as defined in claim 4, wherein said rope support is mounted on two lower chords of the intermediate member in the region of said shackle means, said rope support being pivotally positioned with respect to said end hinged element and said intermediate member.

6. The crane as defined in claim 5, wherein said shackle means include a connecting shackle, a first shackle rigidly connected to the upper chord of the hinged element and a second shackle rigidly connected to the upper chord of the intermediate member, said connecting shackle being pivotally connected to said first shackle and said second shackle, respectively.

7. The crane as defined in claim 6, said connecting shackle and said first shackle each being formed with a similar hole; the crane including an additional pin insertable in the holes of the connecting shackle and the first shackle, said first shackle being pivotable about said additional pin.

8. The crane as defined in claim 7, wherein said connecting shackle and said second shackle are each formed with the aforementioned oblong opening for receiving said aforementioned pin, said second shackle being pivotable about said aforementioned pin.

9. The crane as defined in claim 8, wherein said connecting shackle includes a plurality of plates spaced from each other and forming a bridge between the first shackle and the second shackle.

10. The crane as defined in claim 6, wherein said first shackle is welded to the upper chord of the hinged element and the second shackle is welded to the upper chord of the intermediate member.

11. The crane as defined in claim 9, wherein said first shackle is formed with a projection with a first bearing surface, said connecting shackle having a bearing plate at a lower edge thereof, said bearing surface abutting against said bearing plate when said first shackle is pivoted towards said connecting shackle, said second shackle being formed with a hooked lug having a bearing surface and said connecting shackle having a second bearing plate at an upper edge thereof, said bearing surface of the hooked lug abutting against the bearing plate at said upper edge when said second shackle is pivoted with respect to said connecting shackle, said first bearing surface and said second bearing surface abutting against the respective bearing plates alternately.

12. The crane as defined in claim 11, wherein said first and second shackles are each provided with lateral auxiliary shackles.

13. The crane as defined in claim 12, wherein the upper chord of the hinged element and the upper chord of the intermediate member are connected to the respective auxiliary shackles by connecting rods.

14. The crane as defined in claim 13, wherein said plates of said connecting shackle are connected to each other and to the auxiliary shackles of the first and second shackles respectively by tubular members welded to the respective plates, said first mentioned pin and said additional pin extending through respective tubular members.

15. The crane as defined in claim 14, further including connecting plates pivotally connecting said hinged element and said intermediate member to each other.

16. The crane as defined in claim 15, wherein said connecting plates extend transversely to the respective upper chords of the hinged element and the intermediate member and connected to each other by means of a pivot axle extended in the direction parallel to said upper chords and laterally spaced from said upper chords.

17. The crane as defined in claim 16, wherein the lower chords of the boom tip are pivotally connected to the respective lower chords of the intermediate member by means of additional pivotable shackles.

* * * * *